US006154185A

United States Patent [19]

Watanabe

[11] Patent Number: 6,154,185

[45] Date of Patent: Nov. 28, 2000

[54] REFLECTING MATERIAL FOR ANTENNAS USABLE FOR HIGH FREQUENCIES

[75] Inventor: Akihito Watanabe, Fukui, Japan

[73] Assignee: Sakase-Adtech Co., Ltd., Fukui, Japan

[21] Appl. No.: 09/297,093

[22] PCT Filed: Sep. 18, 1998

[86] PCT No.: PCT/JP98/04233

§ 371 Date: May 18, 1999

§ 102(e) Date: May 18, 1999

[87] PCT Pub. No.: WO99/14821

PCT Pub. Date: Mar. 25, 1999

[30] Foreign Application Priority Data

Sep. 18, 1997 [JP] Japan ..... 9-270339

[51] Int. Cl.[7] ..... H01Q 1/36

[52] U.S. Cl. ..... 343/897; 343/912; 343/915; 343/DIG. 2

[58] Field of Search ..... 343/897, 912, 343/915, DIG. 2; 428/408; 139/383 R; H01Q 1/36

[56] References Cited

U.S. PATENT DOCUMENTS

| | | | |
|---|---|---|---|
| 3,874,422 | 4/1975 | Dow | 139/383 R |
| 4,438,173 | 3/1984 | Trost | 428/408 |
| 4,868,580 | 9/1989 | Wade | 343/897 |
| 5,168,005 | 12/1992 | Keating et al. | 428/229 |
| 5,686,930 | 11/1997 | Brydon | 343/897 |
| 5,702,993 | 12/1997 | Kubomura et al. | 428/408 |

FOREIGN PATENT DOCUMENTS

| | | |
|---|---|---|
| 7-226619 | 8/1995 | Japan . |
| 8-130409 | 5/1996 | Japan . |
| 8-307146 | 11/1996 | Japan . |

*Primary Examiner*—Don Wong
*Assistant Examiner*—Hoang Nguyen
*Attorney, Agent, or Firm*—Armstrong, Westerman, Hattori, McLeland & Naughton

[57] ABSTRACT

An antenna-oriented reflecting material using triaxial woven fabric is usable for frequency bands as high as 20–60 GHz. A reflecting material 1 usable for the high frequency bands is manufactured without spoiling advantages of triaxial woven fabric 2 by controlling mainly a construction n, a volume resistivity ρ and a mass per unit length η of the triaxial woven fabric. Particularly the setting of each parameter is determined by a composite model reflection ratio Γ obtained from a sum of a first reflection ratio Γ's based on a surface resistance of the triaxial woven fabric and a second reflection ratio Γp based on opening, holes of the triaxial woven fabric. It is preferable that a construction be 5–28 yards/in a mass per unit length η be 10–460 tex g/1000 m, and a volume resistivity ρ be 0.7 to $2.0\times10^{-3}$ Ω·cm.

9 Claims, 11 Drawing Sheets

REFLECTION RATIO OF TRIAXIAL WOVEN FABRICS

REFLECTION RATIO OF TRIAXIAL WOVEN FABRICS

REFLECTION RATIO OF TRIAXIAL WOVEN FABRICS

REFLECTION RATIO OF TRIAXIAL WOVEN FABRICS
CALCULATED VALUE

REFLECTION RATIO OF TRIAXIAL WOVEN FABRICS
EXPERIMENTAL VALUE

REFLECTION RATIO OF TRIAXIAL WOVEN FABRICS
CALCULATED VALUE

REFLECTION RATIO OF TRIAXIAL WOVEN FABRICS
EXPERIMENTAL VALUE

REFLECTION RATIO OF TRIAXIAL WOVEN FABRICS
CALCULATED VALUE

REFLECTION RATIO OF TRIAXIAL WOVEN FABRICS
EXPERIMENTAL VALUE

REFLECTION RATIO OF TRIAXIAL WOVEN FABRICS
CALCULATED VALUE

REFLECTION RATIO OF TRIAXIAL WOVEN FABRICS
INFLUENCE OF THE MASS PER UNIT LENGTH UPON THE REFLECTION RATIO

REFLECTION RATIO OF TRIAXIAL WOVEN FABRICS
INFLUENCE OF THE VOLUME RESISTIVITY UPON THE REFLECTION RATIO

REFLECTION RATIO OF TRIAXIAL WOVEN FABRICS
INFLUENCE OF THE CONSTRUCTION UPON THE REFLECTION RATIO

REFLECTION RATIO OF TRIAXIAL WOVEN FABRICS
INFLUENCE OF THE FIBER DENSITY UPON THE REFLECTION RATIO

REFLECTION RATIO OF TRIAXIAL WOVEN FABRICS
INFLUENCE OF A NUMBER OF FILAMENTS UPON THE REFLECTION RATIO

REFLECTION RATIO OF TRIAXIAL WOVEN FABRICS
INFLUENCE OF A SIZING CONTENT UPON THE REFLECTION RATIO

REFLECTION RATIO OF TRIAXIAL WOVEN FABRICS
INFLUENCE OF A WEAVE TEXTURE UPON THE REFLECTION RATIO

REFLECTING MATERIAL FOR ANTENNAS USABLE FOR HIGH FREQUENCIES

BACKGROUND OF THE INVENTION

1. Field of the Invention

The present invention relates generally to a reflecting material for an antenna using triaxial woven fabrics, and more particularly, to a reflecting material for an antenna usable in frequency bands as high as 20–60 GHz.

2. Description of the Related Art

With expansions of the communications market and the broadcasting field, such as mobile communications and digital broadcasting of TV, etc through artificial satellites, the antenna has increasingly been scaled up and enhanced in terms of power.

In recent years, there has been developed an antenna involving the use of triaxial woven fabrics as a reflecting material and utilizing the characteristics of the triaxial woven fabrics.

The followings are the reasons therefor:

The triaxial woven fabrics have a light weight and a high rigidity, and are easy to scale up as well as being high in terms of accuracy of dimension and configuration thereof.

The triaxial woven fabrics can be designed so that a coefficient of thermal expansion is approximately zero to 0 with a single-layered structure, and exhibits an excellent dimensional stability. triaxial woven fabrics have opening holes and a flexibility thereof to absorb vibrations and an impacts, and are therefore strong against an impact load when launching.

A simple structure of a support member of a reflection surface may suffice.

A forming process can be simplified, and a stabilized quality and a decrease in costs can be attained.

Under such circumstances, there is a demand for the reflecting material of the triaxial woven fabrics which is usable for high frequency micro- and milli-waves through which a much larger quantity of information can be transmitted.

There has hitherto been, however, no antenna-oriented reflecting material using the triaxial woven fabrics, which is usable for frequency bands as high as 20–60 GHz.

It is a primary object of the present invention to provide an antenna-oriented reflecting material using triaxial woven fabrics which is usable for frequency bands as high as 20–60 GHz.

SUMMARY OF THE INVENTION

To accomplish the object described above, the present inventors have discussed that it is feasible to manufacture a reflecting material usable for high frequency bands without spoiling advantages of triaxial woven fabrics by controlling mainly a construction, a volume resistivity and a mass per unit length of the triaxial woven fabrics.

Namely, the present invention is, with an antenna reflecting material being composed of single-layered triaxial woven fabrics, characterized such that the relationship between a reflection ratio and a frequency of radio waves is varied by using as a parameter at least one of a construction, a volume resistivity, a mass per unit length and a fiber density of the triaxial woven fabrics, and each parameter is set so that the reflection ratio falls within an allowable reflection ratio range in a predetermined frequency band.

Namely, one, two or three or all four of the parameters may be changed.

Among these parameters, the three principal parameters are the construction, the volume resistivity and the mass per unit length, and the fiber density may also be conceived important.

A number-of-filaments and a sizing content may also be added as parameters. The number-of-filaments is a factor pertaining to a thickness of the woven fabrics, and bears a proportional relationship with the mass per unit length if a diameter of the single fiber itself is the same. If the diameter of the single fiber itself is different, the number-of-filaments becomes an independent parameter. Further, the sizing content normally assumes a level within a range on the order of 3%, and is defined as an incidental parameter.

The setting of each of those parameters is determined by a composite model reflection ratio Γ obtained from a sum of a first reflection ratio Γs based on a surface resistance of the triaxial woven fabrics and a second reflection ratio Γp based on opening holes of the triaxial woven fabrics.

An influence by the weave opening holes is small in a low frequency band and becomes large when in a higher frequency band.

With this contrivance, each parameter can be set by the calculation, and the reflecting materials exhibiting a variety of frequency characteristics can be rationally designed.

The present invention may also be conceived as a simulation method of the frequency characteristic of the usable-for-high-frequency antenna-oriented reflecting material using the triaxial woven fabrics.

That is, there is provided the simulation method of the frequency characteristic defined as a relationship between a reflection ratio and a frequency of the usable-for-high-frequency antenna-oriented reflecting material composed of single-layered triaxial woven fabrics, by which, with a construction, a volume resistivity, a mass per unit length and a fiber density of the triaxial woven fabrics serving as parameters, the frequency characteristic defined as the relationship between the reflection ratio and the frequency is determined, wherein a composite model reflection ratio Γ obtained from a sum of a first reflection ratio Γs based on a surface resistance of the triaxial woven fabrics and a second reflection ration Γp based on opening holes of the triaxial woven fabrics is used as a simulation model.

The present invention may also be conceived as a contrivance of a parameter setting method of the usable-for-high-frequency antenna-oriented reflecting material using the triaxial woven fabrics.

To be more specific, there is provided the parameter setting method of the usable-for-high-frequency antenna-oriented reflecting material composed of the single-layered triaxial woven fabrics, by which, with the construction, the volume resistivity, the mass per unit length and the fiber density of the triaxial woven fabrics serving as parameters, each of the parameters is set such that the frequency characteristic defined as the relationship between the reflection ratio and the frequency becomes a target frequency characteristic, wherein the composite model reflection ratio Γ obtained from the sum of the first reflection ration Γs based on the surface resistance of the triaxial woven fabrics and the second reflection ration Γp based on the opening holes of the triaxial woven fabrics is used as the simulation model.

As a matter of course, a range of allowable reflection ratios may be set in predetermined frequency bands, and the reflection ratio may also be so set as to fall within the range of the allowable reflection ratios.

The present invention may also be conceived as a method of evaluating a frequency characteristic of a reflection ratio of a usable-for-high-frequency antenna-oriented reflecting material using triaxial woven fabrics in which the frequency characteristic of the reflection ratio is unknown.

More specifically, with the construction, the volume resistivity, the mass per unit length and the fiber density of the triaxial woven fabrics serving as parameters, the composite model reflection ration Γ obtained from the sum of the first reflection ratio Γs based on the surface resistance of the triaxial woven fabrics and the second reflection ratio Γp based on the opening holes of the triaxial woven fabrics is used as the simulation model, and the parameters are inputted into the simulation model, thereby evaluating the frequency characteristic defined as the relationship between the reflection ratio and the frequency.

With respect to the parameters according to the simulation method, the parameter setting method and the frequency characteristic evaluating method, as in the case of the reflecting material for the antenna, the number-of-filaments and the sizing content may be, as a matter of course, added as parameters.

It is preferable that the construction be set to 5–28° C. yarns/in.

If under 5 yarns/in, the reflection ratios of −0.5 dB or above are unable to be obtained in the frequency bands of over 20 GHz. If the construction is over 28 yarns/in, it becomes, as a matter of fact, impossible to manufacture the fabrics in terms of a structural limit of the triaxial woven fabrics.

It is particularly preferable that the construction is set to 7–25 yarns/in.

As discussed above, the fixed reflection ratio can be obtained up to the vicinity of 5 yarns/in, however, if less than the vicinity of 7 yarns/in there is a tendency in which the reflection ratio in the high frequency band sharply drops. It is therefore preferable that the construction is set to over 7 yarns/in. If over 25 [yarns/in], as described above, though capable of manufacturing the fabrics when on the order of 28 yarns/in, a reflection efficiency tends to decline due to an increased damage to the fibers, and hence it is preferable that the construction is approximately 25 yarns/n.

The present invention is characterized such that the mass per unit length is set within a range of 10 to 460 tex g/1000 m.

If the mass unit per length is less than 10 tex, the fiber strength becomes deficient enough to induce the difficulty of manufacturing the fabrics. If larger than 460 tex, it is unfeasible to obtain the reflection ratios of over −0.5 dB in the frequency bands exceeding 20 GHz. If within 10–460 tex, the decrease in the reflection ratios of the radio waves having the frequencies in the frequency bands as high as 20–60 GHz, can be restrained to the greatest possible degree. With this setting, it has empirically been confirmed that the reflection ratio as high as −0.5 dB (wherein an input is approximately 90% of an output) or above can be obtained.

Further, the present invention is characterized such that the volume resistivity is set within a range of $10^{-4}$ to $2.0\times10^{-3}$ Ω·cm. With this setting, the reflection ratios in the high frequency bands can be further enhanced.

It is especially preferable that the volume resistivity be set within a range of $0.7\times10^{-3}$ through $2.0\times10^{-3}$ Ω·cm.

If the volume resistivity is smaller than $0.7\times10^{-3}$, the fibers may become fragile enough to induce the difficulty of manufacturing the fabrics. Whereas if larger than $2.0\times10^{-3}$, it is difficult to design the triaxial woven fabrics usable for the high frequencies.

Moreover, any one of a basic texture and a biplane texture may be used as a woven fabric texture of the triaxial woven fabrics, and, in each of these textures, the reflection ratio of −0.5 dB is obtained in the high frequency bands of over 20 GHz.

The basic texture is composed of a multiplicity of wefts arranged in parallel to each other in a first direction, a multiplicity of first warps arranged in parallel to each other and intersecting orthogonal lines orthogonal to the wefts at approximately 30 degrees inclined to the orthogonal lines, and a multiplicity of second warps arranged in parallel to each other and intersecting the orthogonal lines orthogonal to the wefts at approximately 30 degrees inclined thereto in symmetry with the first warps, wherein groups of the wefts and of the first and second warps are so woven as to intersect each other alternately, of which each weave texture is formed with opening holes assuming a hexagonal shape.

The biplane texture is composed of multi-couples of wefts, each couple consisting of two wefts, arranged in parallel to each other in the first direction, multi-couples of first warps, each couple consisting of two warps, arranged in parallel to each other and intersecting orthogonal lines orthogonal to the wefts at approximately 30 degrees inclined to the orthogonal lines, and multi-couples of second warps, each couple consisting of two warps, arranged in parallel to each other and intersecting the orthogonal lines orthogonal to the wefts at approximately 30 degrees inclined thereto in symmetry with the first warps, wherein groups of the wefts and of the first and second warps are so woven as to intersect each other alternately.

BRIEF DESCRIPTION OF THE DRAWINGS

FIG. 1(*b*) is a diagram showing a woven fabric texture of biplane type triaxial woven fabrics;

FIG. 7(*b*) is an explanatory diagram showing a circular wave guide approximation;

FIG. 8(*b*) is a graph showing how an influence of the fiber density upon the reflection ratio is simulated;

FIG. 9(*b*) is a graph showing how an influence of the volume resistivity upon the reflection ratio is simulated;

FIG. 10(*b*) is a graph showing how an influence of a sizing content upon the reflection ratio is simulated.

DETAILED DESCRIPTION OF THE PREFERRED EMBODIMENT

The present invention will hereinafter be described by way of an illustrative preferred exemplary embodiment.

Figure 1A:
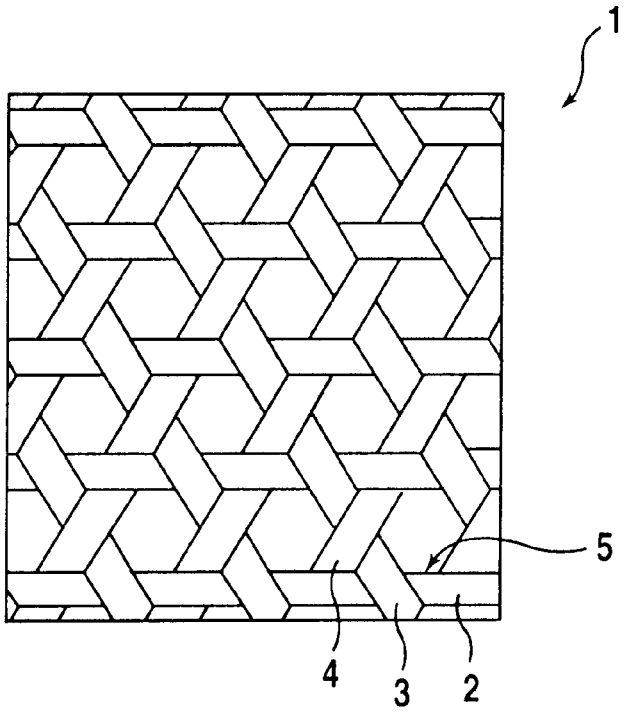
FIG. 1(*a*) is a diagram showing a configuration of an antenna-oriented reflecting material in one embodiment of the present invention.
Figure 1B:
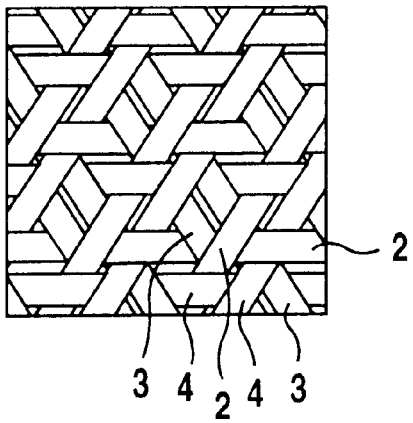

FIG. 1 shows a reflecting material for an antenna usable for high frequencies in a preferred exemplary embodiment of the present invention. Referring to FIG. 1, the numeral 1 designates single-layer triaxial woven fabrics used for the antenna-oriented reflecting material.

The antenna-oriented reflecting material in this embodiment is structured such that a matrix resin is impregnated into the triaxial woven fabrics 1 (not shown).

A woven fabric texture of the triaxial woven fabrics 1 is classified as a basic texture. The basic texture is composed of a multiplicity of wefts 2 arranged in parallel to each other in a first direction, a multiplicity of first warps 3 arranged in parallel to each other and intersecting orthogonal lines orthogonal to the wefts 2 at approximately thirty degrees inclined to the orthogonal lines, and a multiplicity of second warps 4 arranged in parallel to each other and intersecting the orthogonal lines orthogonal to the wefts 2 at approximately thirty degrees inclined thereto in symmetry with the first warps 3. Groups of the wefts 2 and of the first and second warps 3, 4 are so woven as to intersect each other alternately, of which each weave texture is formed with opening holes 5 assuming a hexagonal shape.

Another woven fabric texture of triaxial woven fabrics 1 may be a biplane texture in which the wefts 2 and the first and second warps 3, 4 are, as shown in FIG. 1(*b*), woven so as to shield the opening holes 5 formed in the basic structure described above.

More specifically, the biplane texture is composed of multi-couples of wefts 2, each couple consisting of two wefts, arranged in parallel to each other in the first direction, multi-couples of first warps 3, each couple consisting of two warps, arranged in parallel to each other and intersecting orthogonal lines orthogonal to the wefts 2 at approximately thirty degrees inclined to the orthogonal lines, and multi-couples of second warps 4, each couple consisting of two warps, arranged in parallel to each other and intersecting the orthogonal lines orthogonal to the wefts 2 at approximately thirty degrees inclined thereto in symmetry with the first warps 3. Groups of the wefts 2 and of the first and second warps 3, 4 are so woven as to intersect each other alternately.

Fibers used for the triaxial woven fabrics 1 reflect radio waves and therefore, it is preferable, exhibit themselves a conductivity. Further, in consideration of their being used in outer space, the costs for launching is in inverse proportion to a square of weight, and it is therefore required that the weight be low. Further, both of a strength and an elastic modulus are required to be high in terms of accuracy of dimension and of configuration, vibrations and an impact load when launching. It is further required in outer space that the function and the configuration at −180 to 130° C. be stabilized, and hence a coefficient of thermal expansion needs to be small. Further, what is preferable as a material has a high thermal conductivity for relieving a temperature difference between an area irradiated with the sunlight and an overshadowed area.

This sort of preferable material may be, e.g., carbon fiber (CF) (containing a graphite fiber). Other usable materials may be conductive fibers or fibers which provide the conductivity through metal plating etc. Providing the conductivity may involve executing a conductivity processing after manufacturing the fabrics.

Further, it is preferable that the matrix resin 3 be composed of a material exhibiting a low degassing property for ensuring the stability of the material quality in outer space, and a small coefficient of moisture expansion for restraining a dehumidifying deformation. For example, polycyanate resin is preferable. Other usable resins are epoxy resin, polyimide resin, etc.

In the present invention a relationship between a reflection ratio [dB] and a frequency f GHz of the radio waves is varied wherein at least one of a construction n yarns/in, a volume resistivity $\rho$ $\Omega$·cm, a mass per unit length $\eta$ tex, a fiber density $\gamma$ g/cm$^3$, a number-of-filaments Fc and a sizing content s, is used as a parameter, and the above parameters are each set such that the reflection ratio falls within a range of an allowable reflection ratio in a predetermined frequency band.

Namely, one or two or three or all of the four parameters may be changed.

The principal parameters among those parameters are the construction n yarns/in, the volume resistivity $\rho$ $\Omega$·cm and the mass per unit length $\eta$ tex. Further, the fiber density $\gamma$ g/cm$^3$ may also be conceived as an important parameter.

On the other hand, the number-of-filaments Fc and the sizing content s may also be added as parameters. The number-of-filaments Fc is a factor pertaining to a thickness of the woven fabrics, and bears a proportional relationship with the mass per unit length if a diameter of the single fiber itself is the same. If the diameter of the single fiber itself is different, the number-of-filaments Fc becomes an independent parameter. Further, the sizing content s normally assumes a level within a range on the order of 3%, and is defined as an incidental parameter.

Those respective parameters are, as expressed in the formula 1, set by a composite model reflection ratio $\Gamma$ obtained from a sum of a first reflection ratio $\Gamma s$ based on a surface resistance Rs of the triaxial woven fabrics and a second reflection ratio $\Gamma p$ based on the opening holes formed in the triaxial woven fabrics. An influence by the weave opening holes is small in a low frequency band and becomes large when in a higher frequency band.

$$\Gamma=\Gamma s+\Gamma p \qquad \text{(Formula 1)}$$

The first reflection ratio $\Gamma s$ can be obtained by the arithmetic formula (3) based on a sheet resistance approximation.

In the arithmetic formula (3), the first reflection ration $\Gamma s$ can be calculated by use of the construciton n, the mass per unit length $\eta$, the volume resistivity $\rho$, the fiber density $\gamma$, the number-of-filaments Fc and the sizing content s. For instance, what R's in the formula (3) is modified and rearranged using those parameters is the formula (4), where c is the crimp coefficient representing a degree of crimp of the woven string.

The first reflection ratio $\Gamma s$ can be obtained also by the arithmetic formula (2) based on Schelkunoff theory.

On the other hand, the second reflection ration $\Gamma p$ can be obtained by the arithmetic formula (6) based on a rectangular wave guide approximation.

In the arithmetic formula (6), the second reflection ratio $\Gamma p$ can be obtained with a configuration and a dimension (geometrically obtained from the construction n) of the opening hole serving as parameters. Namely, FIG. 7(*a*) shows an opening hole width a and an opening holes forming cycle b in the rectangular wave guide approximation, and these values can be geometrically drawn from the construction n. What A, B and β in the formula (6) are modified and rearranged based on those values is the formula (7).

Note that the second reflection ration Γp can, in addition to the above-mentioned, also be obtained by the arithmetic formula (5) using a circular wave guide approximation, or by a reflection ratio based on a mesh analysis model, etc.

Figure 7A:
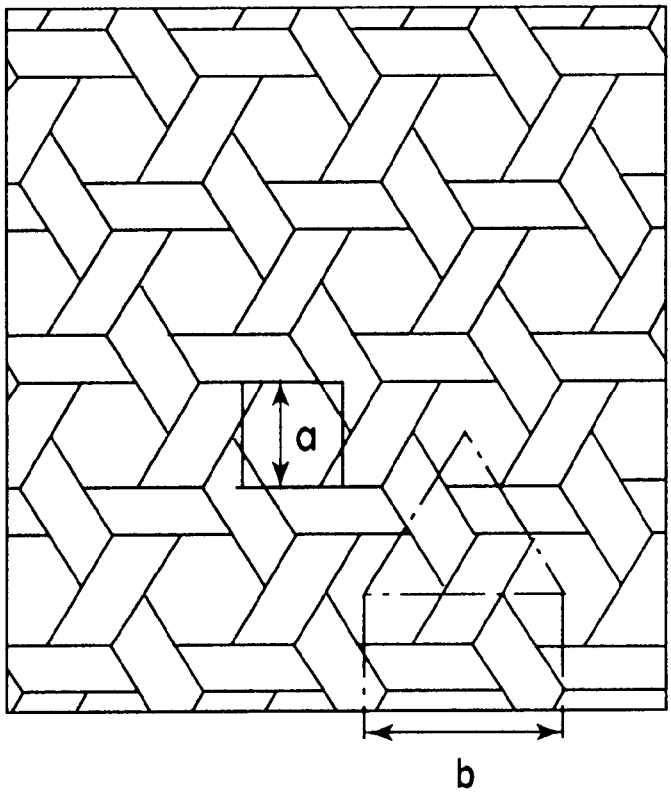
FIG. 7(*a*) is an explanatory diagram showing a rectangular wave guide approximation.
Figure 7B:
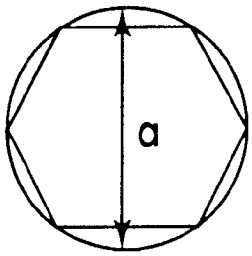

FIG. 7(*b*) shows a radius a of the circumscribed circle and the opening holes forming cycle b in the circular wave guide approximation, and these values are also geometrically determined.

Further, in the case of the mesh analysis mode, though not particularly illustrated, the analysis is performed, wherein the unit thereof is a square mesh surrounding the weave texture.

Figure 2A:
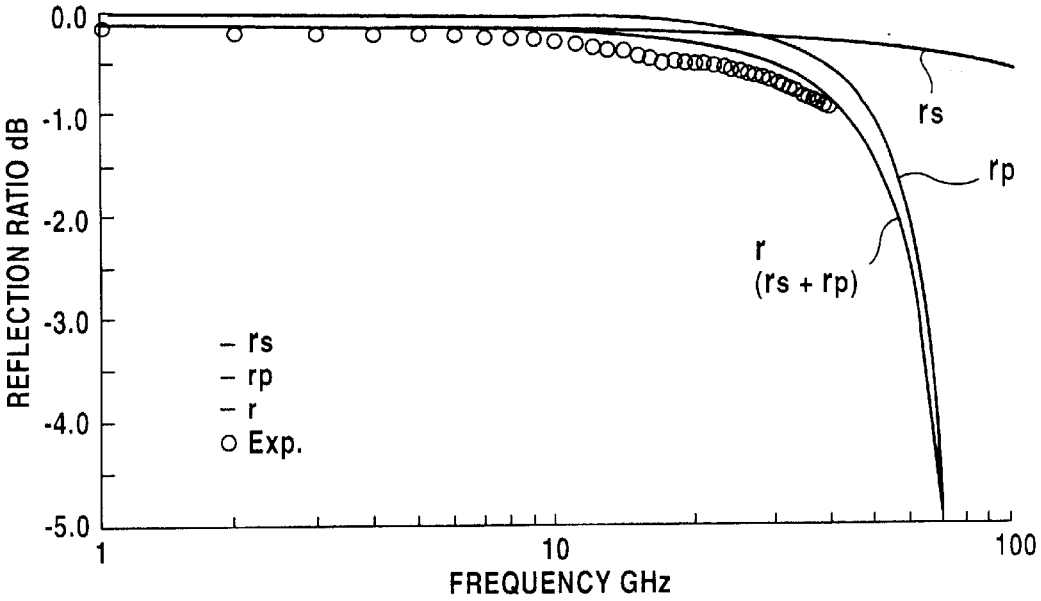
FIGS. 2(*a*) and 2(*b*) are graphs each showing a comparison between a measurement value and a result of a calculation of a composite model reflection ratio.
Figure 2B:
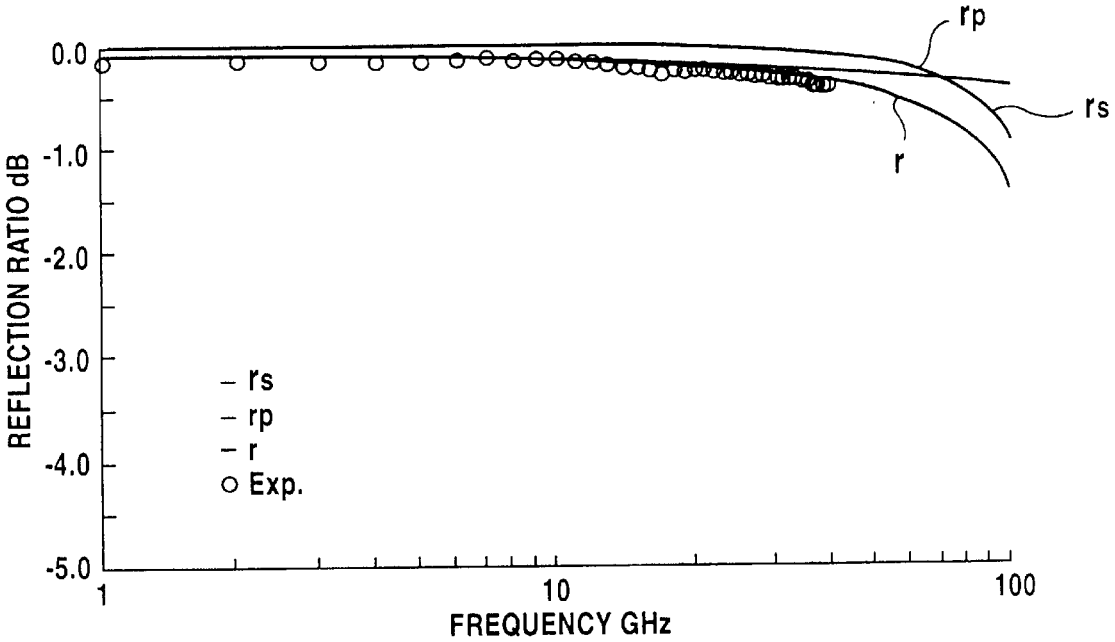

FIG. 2 shows a frequency characteristic of the radio wave reflection ratio of the reflecting material for the antenna in the preferred exemplary embodiment.

The frequency characteristic of the radio wave reflection ratio gradually decreases as the frequency becomes high and sharply drops from a high frequency band of over 20–60 GHz.

In FIG. 2, the plots (○) are actual measurement values and show the first reflection ration Γs, the second reflection ratio Γp which are calculated in by the formulae given above, and the composite model reflection ratio Γ=Γs+Γp calculated as the sum of the first and second reflection ratios.

Obtained herein are, with a string type being a PAN based carbon fiber, and with the woven fabric texture being the basic texture, a reflection ratio of a material 1) of which the volume resistivity (ρ) is $2.0\times10^{-3}$ Ω·cm, the construction is 9.25 yarns/in, and the mass per unit length (η) is 66 tex (FIG. 2(*a*)), and a reflection ratio of a material (2) of which the volume resistivity (ρ) is $1.5\times10^{-3}$ Ω·cm, the construction is 18.5 yarns/in, and the mass per unit length (η) is 33 tex (FIG. 2(*b*)).

As a result, a measurement value is, up to 10 GHz, well coincident with the first reflection ratio Γs obtained by the arithmetic formulae (sheet resistance approximation) (formulae 3 and 4) based on the surface resistance. In this span, the second reflection ration Γp obtained by the arithmetic formulae (formulae 6 and 7) with respect to the opening holes shows almost no change.

When over 10 GHz, the value decreases deviating from the calculated value of the first reflection ration Γs, and a decrease ratio is well coincident with Γ=Γs+Γp.

If the allowable reflection ratio is set to −0.5 dB (in which an input thereof is approximately 90% of an output), it can be known that the material (1) exhibits a characteristic of being usable up to 30 GHz, while the material (2) exhibits a characteristic of being usable up to 60 GHz.

Thus, the reflection ratio calculated by the above formula is well coincident with the actual measurement value over a wide range from the low frequency band to the high frequency band, and it is feasible to design the antenna-oriented reflecting material composed of the triaxial woven fabrics exhibiting a variety of frequency characteristics.

Figure 3A:
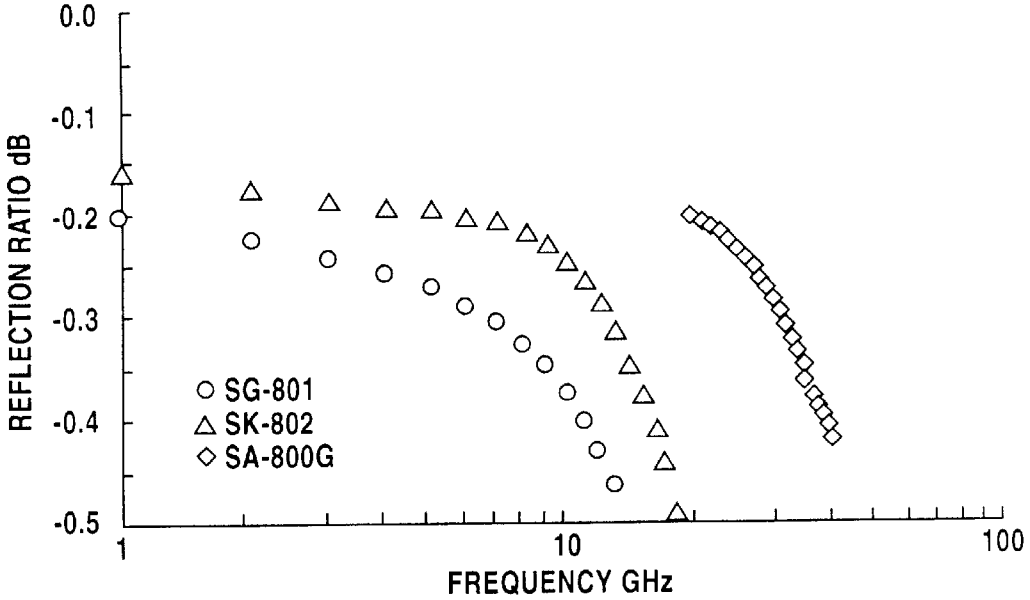
FIGS. 3(*a*) and 3(*b*) are graphs each showing a relationship between a reflection ratio and a frequency with respect to each construction of the antenna-oriented reflecting material in this embodiment.
Figure 3B:
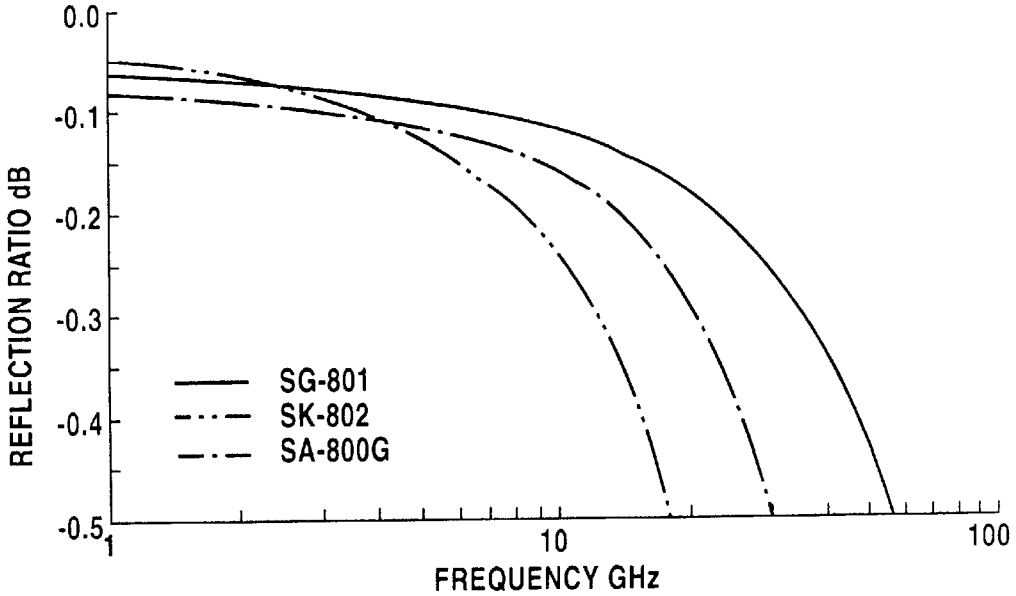
Figure 4A:
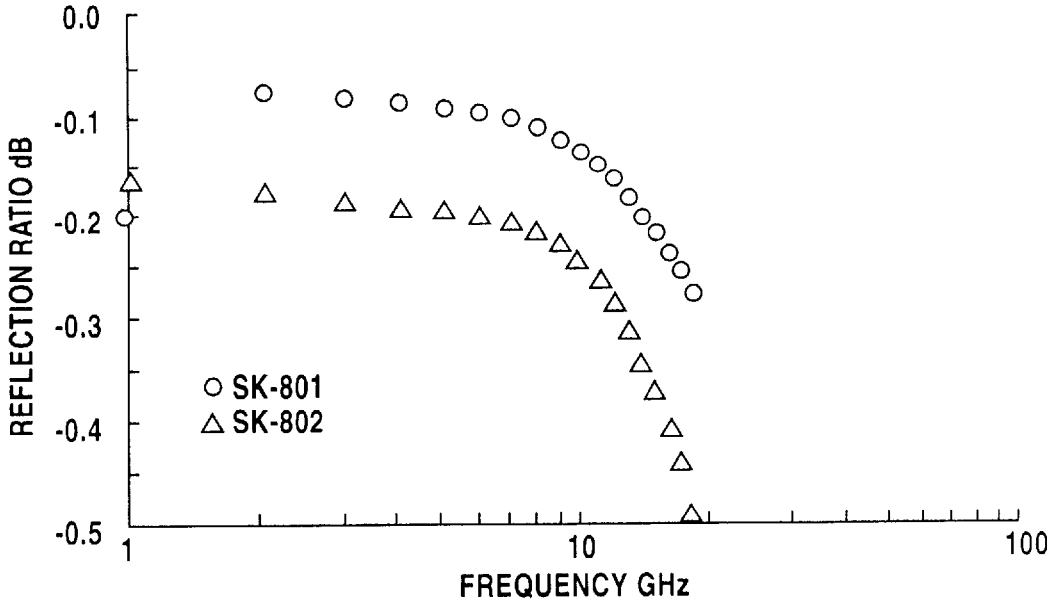
FIGS. 4(*a*) and 4(*b*) are graphs each showing a relationship between a reflection ratio and a frequency with respect to each mass per unit length of the antenna-oriented reflecting material in this embodiment.
Figure 4B:
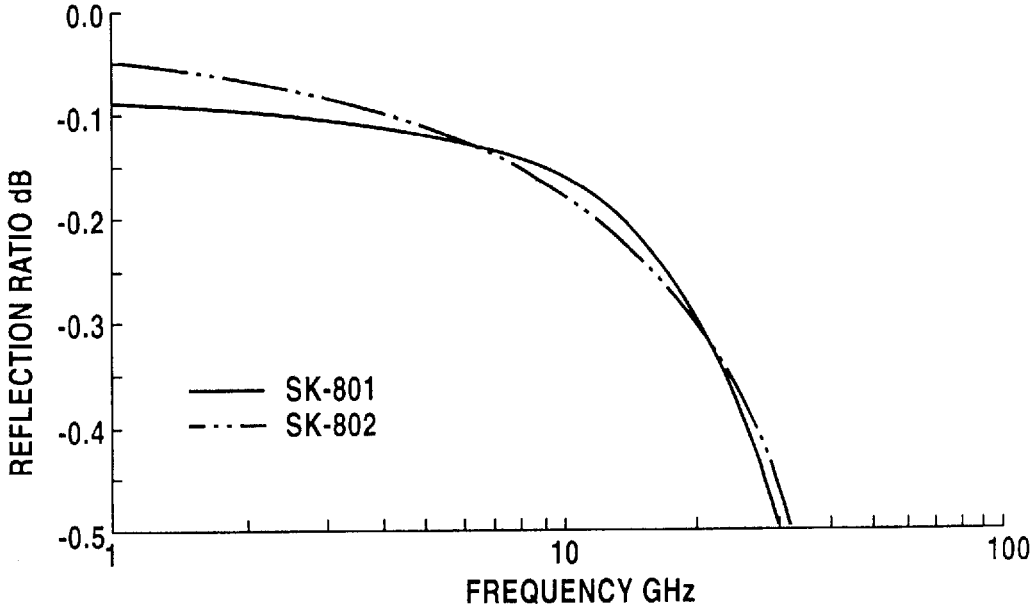
Figure 5A:
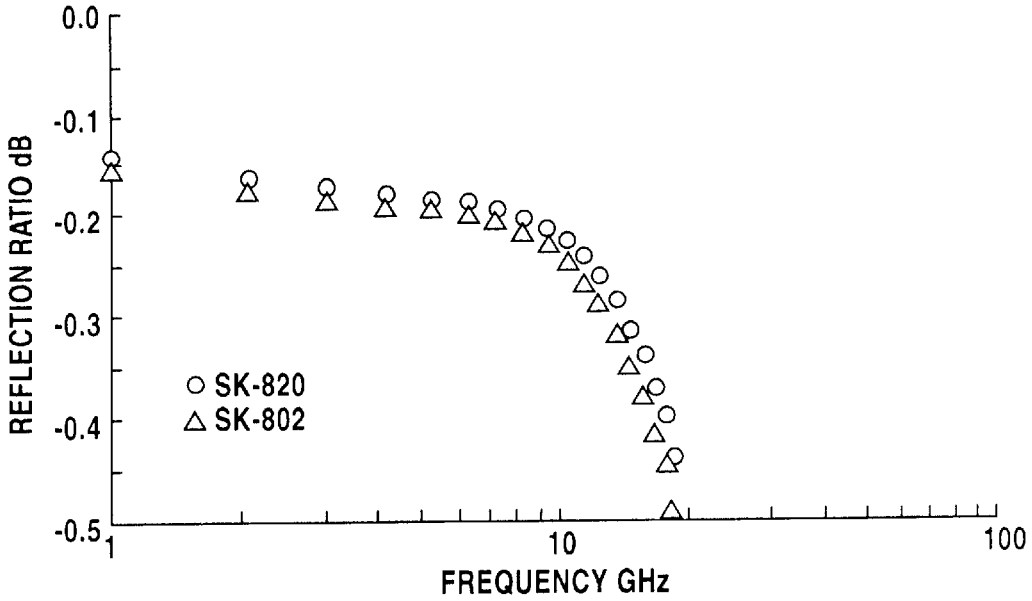
FIGS. 5(*a*) and 5(*b*) are graphs each showing a relationship between a reflection ratio and a frequency with respect to each volume resistivity of the antenna-oriented reflecting material in this embodiment.
Figure 5B:
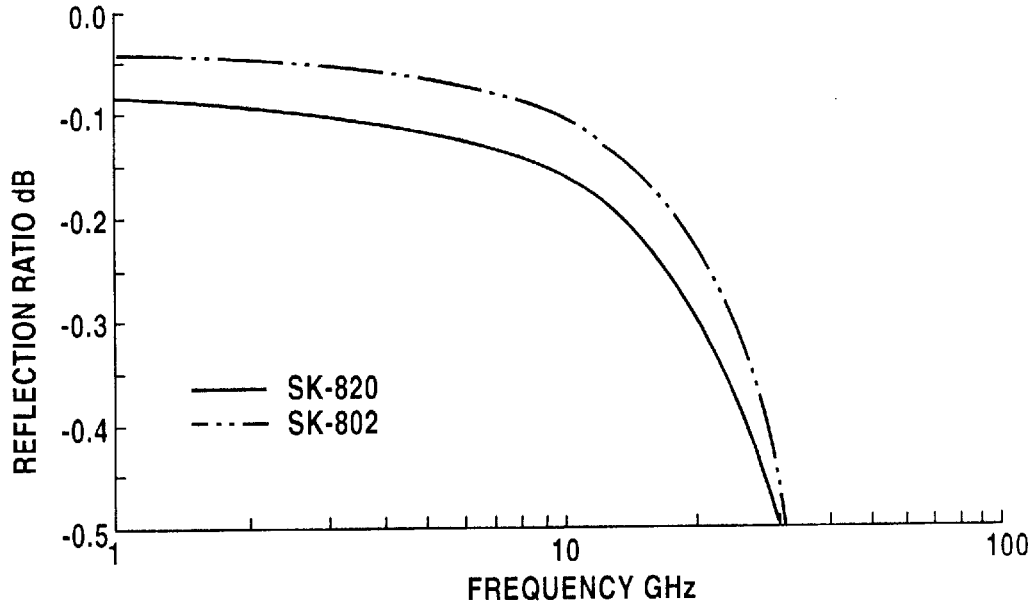

Moreover, FIGS. 3–5 show results of having specifically examined how each of the construction n, the mass per unit length η and the volume resistivity ρ exerts an influence upon the frequency characteristics of the radio wave reflection ratio.

FIG. 3(*a*) shows a result of measuring the frequency characteristic of the radio wave reflection ratio with the construction n serving as a parameter. FIG. 3(*b*) shows a result of the calculation.

Measured herein are , with the string type being the PAN based carbon fiber, and with the woven fabric texture being the basic texture, three types of materials of which the volume resistivity (ρ) is $2.0\times10^{-3}$ Ω·cm, and the construction is 4.625 yarns/in (the mass per unit length η: 396 tex) (SG-801), 9.25 yarns/in, (the mass per unit length η: 198 tex) (SK-802), 18.5 yarns/in (the mass per unit length η: 33 tex) (SA-8005).

If the allowable reflection ratio is set to −0.5 dB (in which the input thereof is approximately 90% of the output), it can be understood that the reflection ratio becomes less than the allowable reflection ratio in the vicinity of exceeding 10 GHz when the construction (n) is 4.625 yarns/in, and meets with the allowable reflection ratio when the construction (n) is 9.25 yarns/in and 18.5 yarns/in.

A consequence of having wholeheartedly pursued the study is that the preferable construction (n) is 5–28 yarns/in. If under 5 yarns/in, the reflection ratios of −0.5 dB or above are unable to be obtained in the frequency bands of over 20 GHz. If the construction is over 28 yarns/in, it becomes, as a matter of fact, impossible to manufacture the fabrics in terms of a structural limit of the triaxial woven fabrics.

It is particularly preferable that the construction is set to 7–25 yarns/in. As discussed above, the fixed reflection ratio can be obtained up to the vicinity of 5 yarns/in, however, if less than the vicinity of 7 yarns/in, there is a tendency in which the reflection ratio in the high frequency band sharply drops. Such being the case, it is preferable that the construction is set to over 7 yarns/in. If over 25 yarns/in, as described above, though capable of manufacturing the fabrics when on the order of 28 yarns/in, a reflection efficiency tends to decline due to an enlarged damage to the fibers, and hence it is preferable that the construction is approximately 25 yarns/in.

FIG. 4(*a*) shows a result of measuring the frequency characteristic of the radio wave reflection ratio with the mass per unit length (η) serving as a parameter. FIG. 4(*b*) shows a result of the calculation.

Measured herein are, with the string type being the PAN based carbon fiber, and with the woven fabric texture being the basic texture, two types of materials of which the construction (n) is 9.25 yarns/in, the volume resistivity (ρ) is $2.0\times10^{-3}$ Ω·cm, and the mass per unit length η is 33 tex (g/1000 m) (SK-802) and 198 tex (SK-801).

As a consequence, it has proven that the reflection ratio is more enhanced as the mass per unit length (η) becomes larger.

A result of having wholeheartedly pursued the study is that if the mass per unit length (η) is thinner than 10 tex, the fiber strength becomes deficient, and the reflection ratio declines with a difficulty of manufacturing both of the fibers and the triaxial woven fabrics. Further, if larger than 460 tex, it is unfeasible to obtain reflection ratios of over −0.5 dB (in which the input thereof is approximately 90% of the output) in the frequency bands exceeding 20 GHz. If within 10–460 tex, it has been confirmed that the decrease in the reflection ratios of the radio waves having the frequencies in the frequency bands as high as 20–60 GHz, can be restrained to the greatest possible degree.

Further, FIG. 5(*a*) shows a result of measuring the frequency characteristic of the radio wave reflection with the fiber volume resistivity (ρ) serving as a parameter. FIG. 5(*b*) shows a result of the calculation thereof.

Herein, there are prepared two string types such as the PAN based carbon fiber and a Pitch based carbon fiber, the woven fabric texture is classified as the basic texture, the construction (n) is set to 9.25 yarns/in, and the mass per unit length $\eta$ is 66 tex in the PAN based carbon fiber and 60 tex in the Pitch based carbon fiber. The volume resistivity ($\rho$) is $2.0\times10^{-3}$ $\Omega\cdot$cm (SK-802) in the PAN based carbon fiber, and $0.7\times10^{-3}$ $\Omega\cdot$cm (SK-920) in the Pitch based carbon fiber.

As a result, it has proven that the reflection ratio is more enhanced with a smaller volume resistivity ($\rho$).

Generally, the volume resistivity of the carbon fiber suitable for use falls within a range of $10^{-4}$ through $2.0\times10^{-3}$ $\Omega\cdot$cm. With this setting, the reflection ratios in the high frequency band given above can be further enhanced.

It is particularly preferable that the volume resistivity be set within a range of $0.7\times10^{-3}$ through $2.0\times10^{-3}$ $\Omega\cdot$cm. If the volume resistivity is smaller than $0.7\times10^{-3}$, the fibers might become fragile enough increase the difficulty of manufacturing the fabrics. Whereas if larger than $2.0\times10^{-3}$, it is difficult to design the triaxial woven fabrics usable for the high frequencies.

Figure 6A:
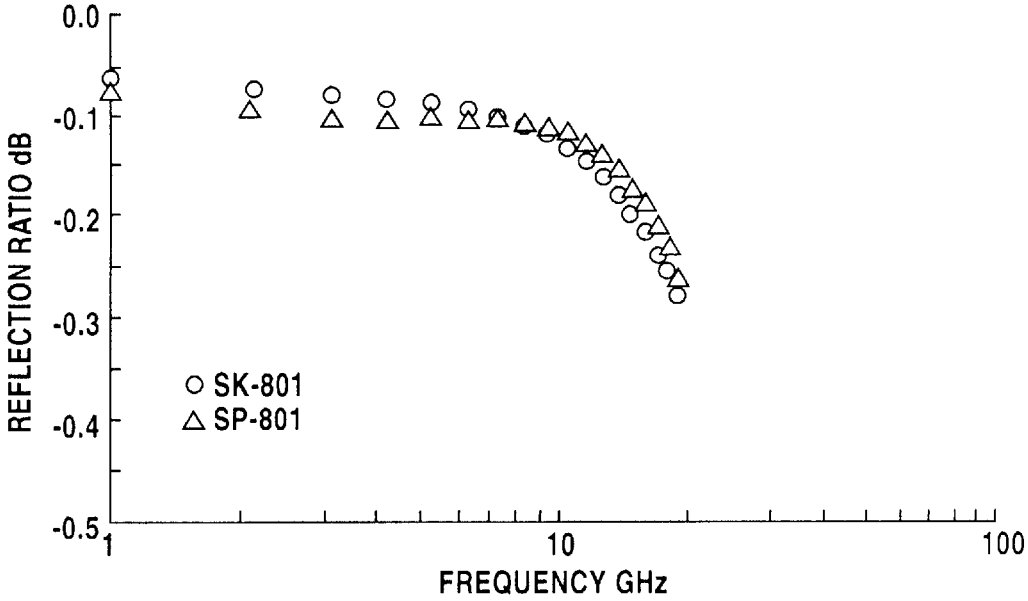
FIGS. 6(*a*) and 6(*b*) are graphs each showing a relationship between a reflection ratio and a frequency with respect to each woven fabric texture of the antenna-oriented reflecting material in this embodiment.
Figure 6B:
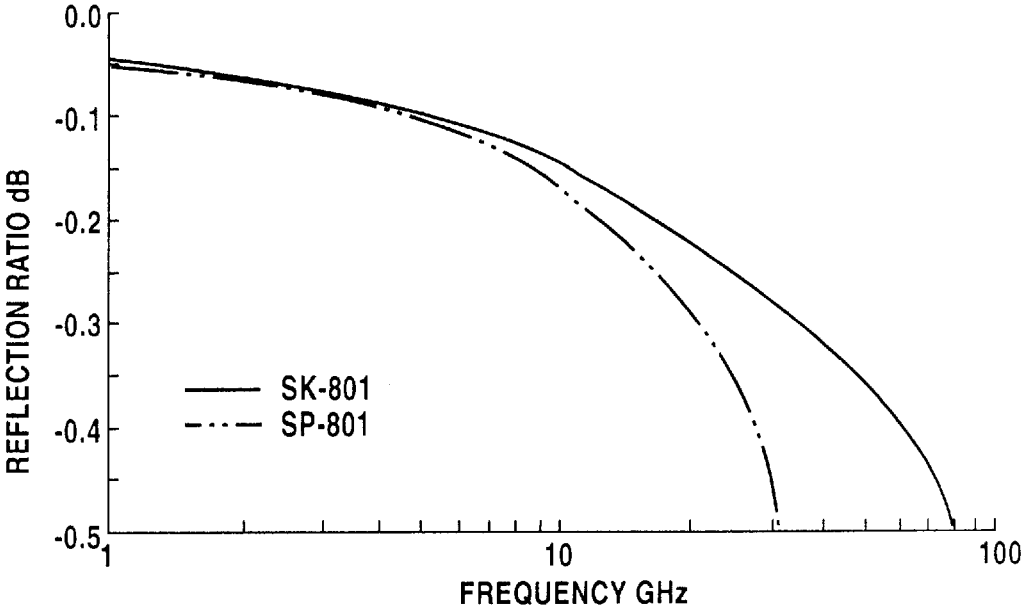

Moreover, FIG. 6(*a*) shows a result of measuring the frequency characteristic of the radio wave reflection with respect to the woven fabric texture. FIG. 6(*b*) shows a result of the calculation thereof.

Measured herein are materials of which the string type is the PAN based carbon fiber, with the construction (n) being unable to be simply compared, an areal weight is set to 220 g/m$^2$ and 150 g/m$^2$, the mass per unit length ($\eta$) is 198.66 tex, and the volume resistivity ($\rho$) is $2.0\times10^{-3}$ $\Omega\cdot$cm.

As a result, it has proven that the radio wave reflection ratio is more enhanced in the biplane texture (SP-802) than in the basic texture (SK-801).

In the present situation, with respect to the basic texture, a reflection ratio of −0.5 dB is obtained at 60 GHz under such a condition that the construction (n) is 18.5 yarns/in, the mass per unit length ($\eta$) is 33 tex, and the volume resistivity ($\rho$) is $1.5\times10^{-3}$ $\Omega\cdot$cm.

Further, in the biplane texture, the reflection ratio of −0.5 dB is obtained at 80 GHz under such a condition that the construction (n) is 18.5 yarns/in, the mass per unit length ($\eta$) is 66 tex, and the volume resistivity ($\rho$) is $2.05\times10^{-3}$ $\Omega\cdot$cm.

Accordingly, the biplane is more effective than the basic texture in terms of only the reflection ratio because of the opening area of the opening hole portion being smaller. The basic texture is, however, conceived more preferable when totally considering a forming property, a material property, a functional property and a stability of configuration etc.

FIGS. 3–6 show the test examples of the changes in the reflection ratio when changing the respective parameters. In fact, however, the carbon fiber used for the test is a standardized product of a fiber manufacturer, and it is impossible in the present situation to perform the test by individually independently varying the respective parameters. The test examples given above are therefore influenced by changes in other parameters. Accordingly, it is unfeasible in the present situation to actually measure the influence given by the individual parameter, which makes it difficult to design a characteristic of the reflection ratio.

According to the present invention, it is possible to simulate the influence of the individual parameter upon the characteristic of the reflection ratio by use of the composite model reflection ration $\Gamma$ obtained from the sum of the first reflection ration $\Gamma s$ based on the surface resistance of the triaxial woven fabrics and the second reflection ration $\Gamma p$ based on the opening holes of the triaxial woven fabrics, whereby the rational design can be attained.

Figure 8A:
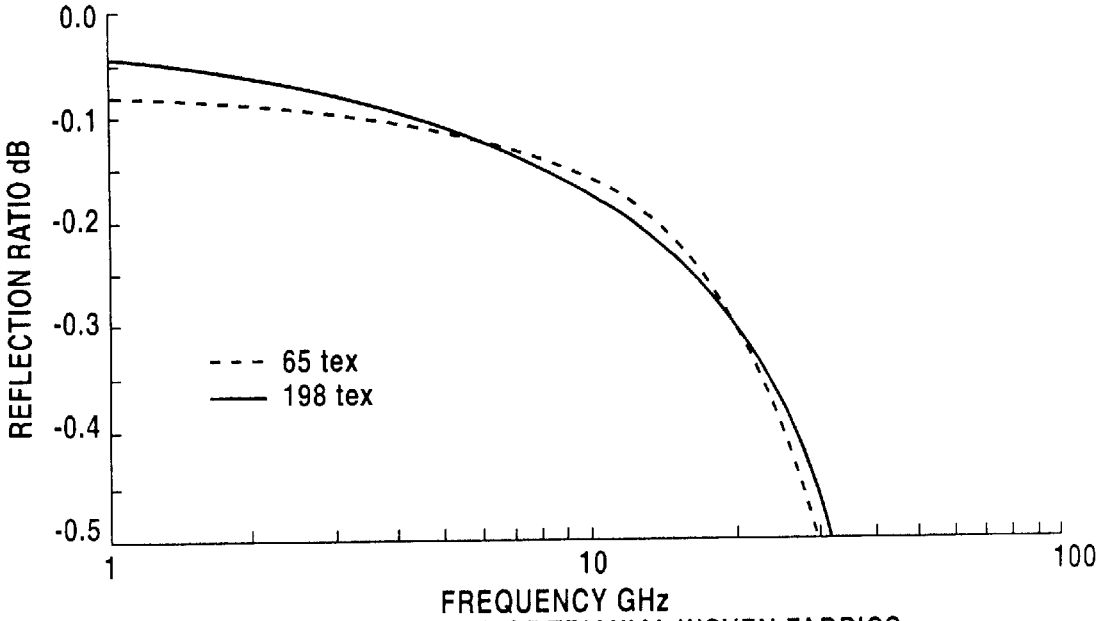
FIG. 8(*a*) is a graph showing how an influence of the construction upon the reflection ratio is simulated.
Figure 8B:
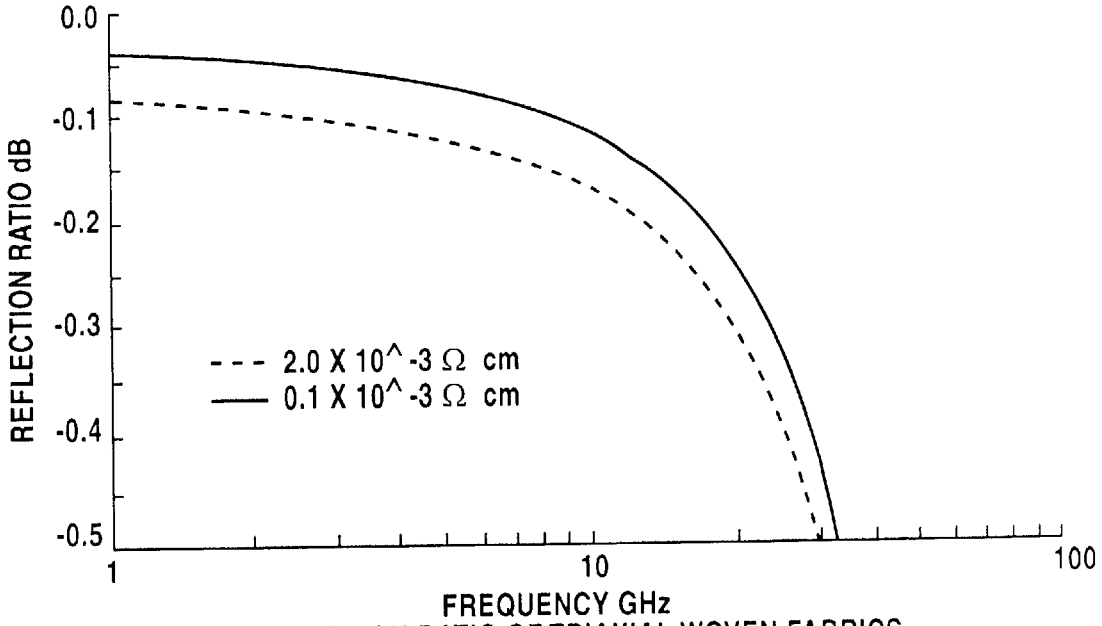
Figure 9A:
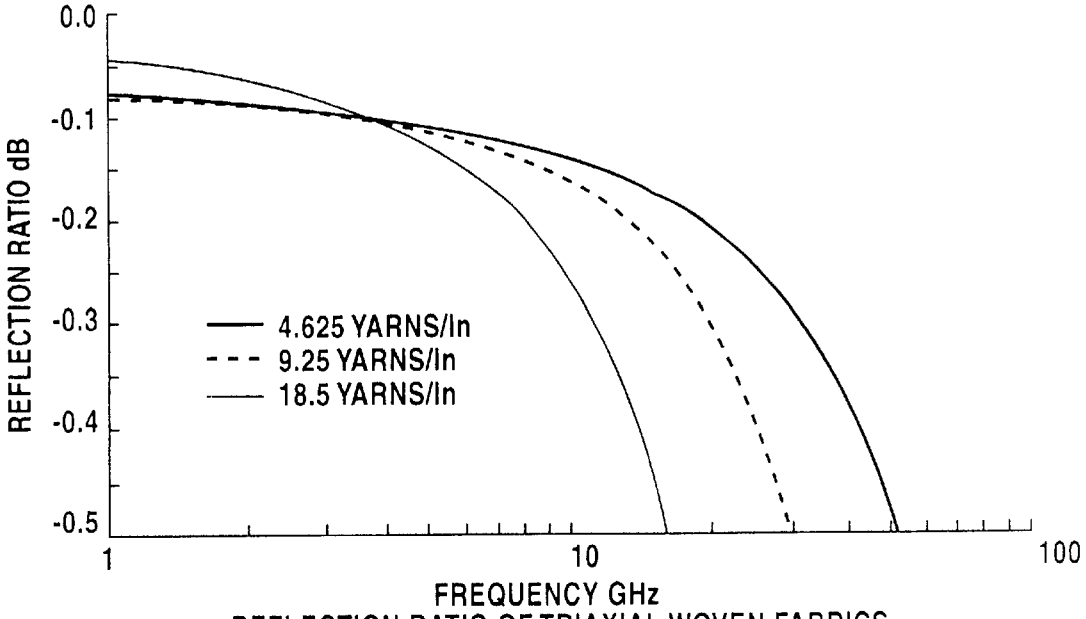
FIG. 9(*a*) is a graph showing how an influence of the mass per unit length upon the reflection ratio is simulated.
Figure 9B:
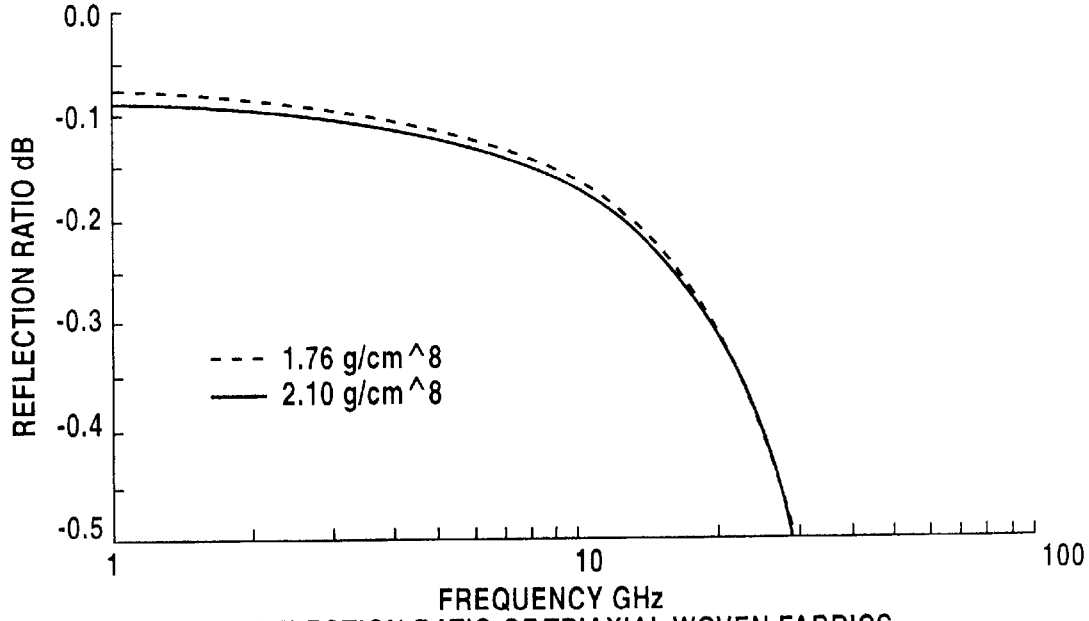
Figure 10A:
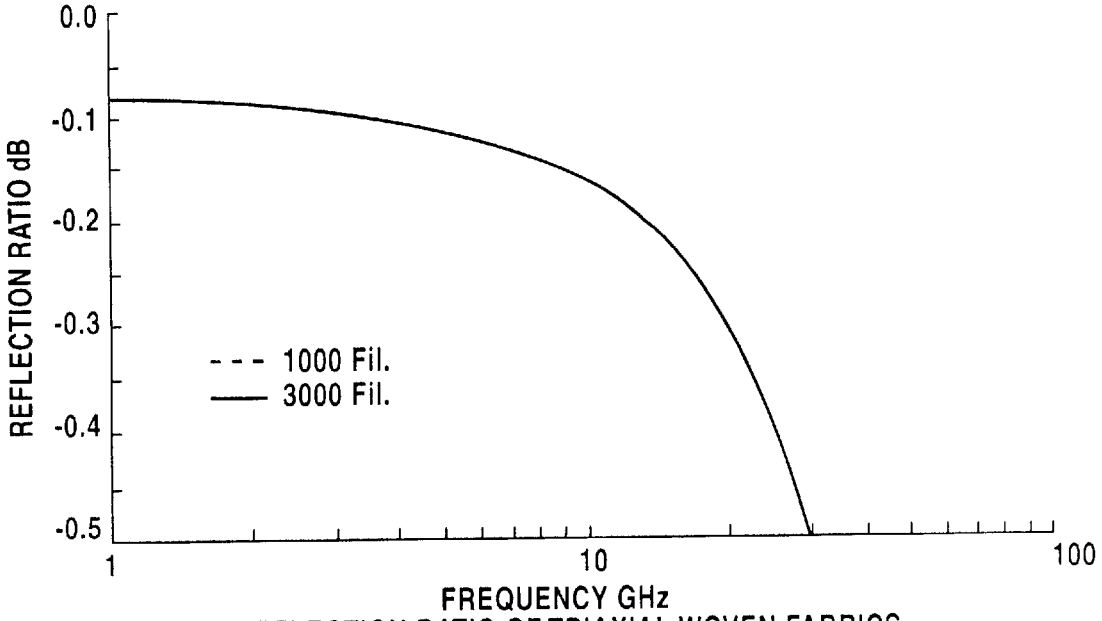
FIG. 10(*a*) is a graph showing how an influence of a number-of-filaments upon the reflection ratio is simulated.
Figure 10B:
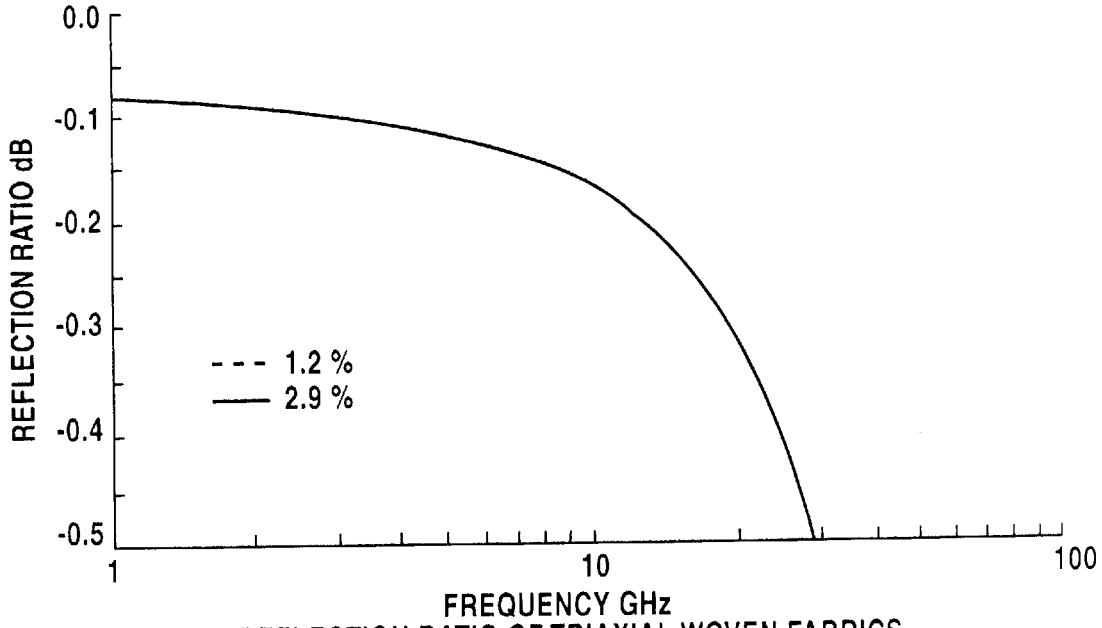

For example, FIGS. 8–10 show a result of the simulation of the characteristic of the reflection ratio when varying the individual parameters.

FIG. 8(*a*) is a graph showing an influence calculated when only the construction n is changed. FIG. 8(*b*) is a graph showing an influence calculated when only the fiber density y is changed. FIG. 9(*a*) is a graph showing an influence calculated when only the mass per unit length $\eta$ is changed. FIG. 9(*b*) is a graph showing an influence calculated when only the volume resistivity $\rho$ is varied. FIG. 10(*a*) is a graph showing an influence when the number-of-filaments Fc is changed. FIG. 10(*b*) is a graph showing an influence calculated when the sizing content s is changed. Thus, it can be understood that the influence is small with respect to the number-of-filaments Fc and the sizing content s.

Figure 11:
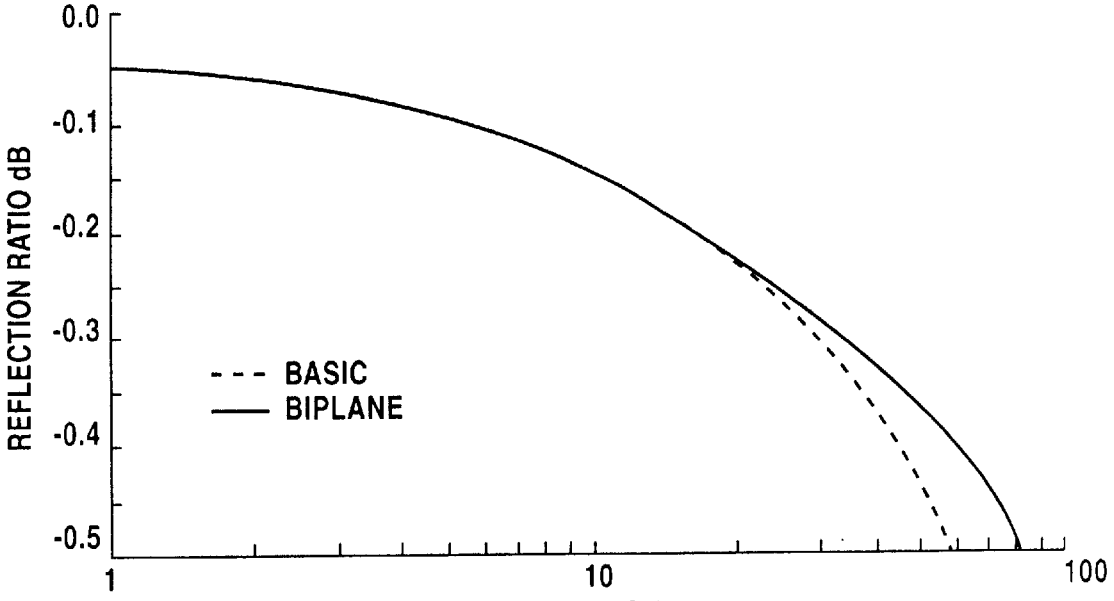
FIG. 11 is a graph showing how an influence of a weave texture upon the reflection ratio is simulated.

Further, FIG. 11 shows influences when the weave texture is the basic texture and when being the biplane texture. It can be comprehended that the decrease in the reflection ratio is smaller with a higher frequency in the biplane texture than in the basic texture.

As discussed above, according to the present invention, the reflecting material usable for the high frequency band can be manufactured without eliminating the advantages of the triaxial woven fabrics by controlling mainly the construction (n), the volume resistivity ($\rho$) and the mass per unit length ($\eta$) of the triaxial woven fabrics. The construction (n), the volume resistivity ($\rho$) and the mass per unit length ($\eta$) may be set so that the reflection ratio of the radio waves fall within the range of the allowable reflection ratios in the predetermined frequency bands.

Schelkunoff:
Rs: surface resistance, $\Omega\cdot\square$
t: thickness, mm
$\sigma$: conductivity
$\mu0$: magnetic permeability in vacuum, $4.0\pi\times10^{-7}$
$\epsilon0$: dielectric constant, $8.8542\times10^{-12}$
Z0: wave impedance in free space, 376.7 $\Omega$
f: frequency, Hz
$\mu r$: magnetic permeability, 1.0
$\epsilon r$: specific dielectric constant, 2.5
(Sheet resistance approximation)
Based-on-surface-resistance reflection ratio approximate calculation:
Rs: surface resistance, $\Omega\cdot\square$
t: thickness, mm
$\sigma$: conductivity
$\mu0$: magnetic permeability in vacuum, $4.0\pi\times10^{-7}$
$\epsilon0$: dielectric constant, $8.8542\times10^{-12}$
Z0: wave impedance in free space, 376.7 $\Omega$
f: frequency, Hz
$\alpha$: attenuation constant
C. C. Chen
Circular Openings with Equilateral Triangular Lattice:
(Circular wave guide approximation)
a: radius of circumscribed circle, mm
b: opening hole forming cycle, mm
$\lambda$: wave length, mm 299792458/f×1000
f: frequency, Hz
t: thickness, mm
C. C. Chen
Square Openings with Equilateral Triangular Lattice:
(Rectangular wave guide approximation)
a: radius of circumscribed circle, mm
b: opening hole forming cycle, mm
$\lambda$: wave length, mm 299792458/f×1000
f: frequency, GHz
t: thickness, mm

What is claimed is:

1. An antenna-oriented reflecting material usable for high frequencies, comprising:

a single-layered triaxial woven fabric, wherein a relationship between a frequency and a reflection ratio of radio waves is varied with at least one of a construction, a volume resistivity, a mass per unit length and a fiber density of said triaxial woven fabric serving as a parameter, and each parameter is set such that the reflection ratio is within a range of an allowable reflection ratio in a predetermined frequency band, wherein the setting of each parameter is determined by a composite model reflection ratio Γ obtained from a sum of a first reflection ratio Γs based on a surface resistance of said triaxial woven fabric and a second reflection ratio Γp based on opening holes of said triaxial woven fabric.

2. An antenna-oriented reflecting material usable for high frequencies according to claim 1, wherein at least one of a number-of-filaments and a sizing content is added to the parameters.

3. An antenna-oriented reflecting material usable for high frequencies according to claim 1 or claim 2, wherein the construction is 5–28 yards/in.

4. An antenna-oriented reflecting material usable for high frequencies according to claim 3, wherein the construction is 7–25 yards/in.

5. An antenna-oriented reflecting material usable for high frequencies according to claim 1 or claim 2, wherein the mass per unit length is set within a range of 10–460 tex g/1000 m.

6. An antenna-oriented reflecting material usable for high frequencies according to claim 1 or claim 2, wherein the volume resistivity is set within a range of $10^{-4}$ to $2.0\times10^{-3}$ Ω·cm.

7. An antenna-oriented reflecting material usable for high frequencies according to claim 6, wherein the volume resistivity is set within a range of $0.7\times10^{-3}$ to $2.0\times10^{-3}$ Ω·cm.

8. An antenna-oriented reflecting material usable for high frequencies according to claim 1 or claim 2, wherein a woven fabric texture of said triaxial woven fabric is a basic texture composed of a multiplicity of wefts arranged in parallel to each other in a first direction, a multiplicity of first warps arranged in parallel to each other and intersecting, orthogonal lines orthogonal to the wefts at approximately thirty degrees inclined to the orthogonal lines, and a multiplicity of second warps arranged in parallel to each other and intersecting the orthogonal lines orthogonal to the wefts at approximately thirty degrees inclined thereto in symmetry with the first warp, and groups of the wefts and of the first and second warps are woven so as to intersect each other alternately, of which each weave texture is formed with opening holes assuming a hexagonal shape.

9. An antenna-oriented reflecting material usable for high frequencies according to claim 1 or claim 2, wherein a woven fabric texture of said triaxial woven fabric is a biplane texture composed of multi-couples of wefts, each couple consisting of two wefts, arranged in parallel to each other in the first direction, multi-couples of first warps, each couple consisting of two warps, arranged in parallel to each other and intersecting orthogonal lines orthogonal to the wefts at approximately thirty degrees inclined to the orthogonal lines, and other and intersecting the orthogonal lines orthogonal to the wefts at approximately thirty degrees inclined thereto in symmetry with the first warps, and wherein groups of the wefts and of the first and second warps are woven so as to intersect each other alternately.

* * * * *